US005080174A

United States Patent [19]

Hynes

[11] Patent Number: 5,080,174

[45] Date of Patent: Jan. 14, 1992

[54] HYDRAULIC PACKOFF AND CASING HANGER INSTALLATION TOOL

[75] Inventor: Joseph H. Hynes, Houston, Tex.

[73] Assignee: Cooper Industries, Inc., Houston, Tex.

[21] Appl. No.: 641,165

[22] Filed: Jan. 14, 1991

[51] Int. Cl.[5] ..... E21B 33/04

[52] U.S. Cl. ..... 166/382; 166/120; 166/123; 166/182; 166/208; 166/348; 166/387

[58] Field of Search ..... 166/208, 182, 382, 387, 166/120, 348, 125, 123, 72, 73

[56] References Cited

U.S. PATENT DOCUMENTS

| | | | |
|---|---|---|---|
| 3,093,996 | 6/1963 | Jones | 73/46 |
| 3,279,539 | 10/1966 | Brown et al. | 166/27 |
| 3,357,486 | 12/1967 | Brown | 166/0.6 |
| 3,543,847 | 12/1970 | Haeber | 166/0.6 |
| 3,897,823 | 8/1975 | Ahlstone | 166/120 |
| 3,924,679 | 12/1975 | Jansen, Jr. | 166/182 |
| 4,003,434 | 1/1977 | Garrett et al. | 166/120 X |
| 4,019,579 | 4/1977 | Thuse | 166/123 |
| 4,019,580 | 4/1977 | Garrett | 166/315 |
| 4,067,062 | 1/1978 | Baugh | 166/125 |
| 4,353,420 | 10/1982 | Miller | 166/382 |
| 4,880,061 | 11/1989 | Ahlstone | 166/348 |
| 4,969,519 | 11/1990 | Kelly | 166/348 |

*Primary Examiner*—Hoang C. Dang

*Attorney, Agent, or Firm*—Nelson A. Blish; Alan R. Thiele; Hebert E. Cox

[57] ABSTRACT

A hydraulic casing hanger and packoff installation tool includes a central tubular member with a drill pipe upper connection and an annular chamber at the lower end thereof with a pair of concentric axially movable pistons mounted therein. A plurality of fluid passages are positioned in the wall of the tubular member and extend from the piston annular chamber to the middle portion of the tubular member where it exits. The pistons have a lower tubular extension which carries releasable latching mechanism which connects the tool to the packoff to be installed and transmits the axial force of the pistons to the packoff. A drill pipe stinger extends through the annular chamber with a releasable latch mechanism mounted on an enlarged lower portion. The releasable latching mechanism connects the tool to the casing hanger for lowering the casing and hanger into the well bore.

13 Claims, 10 Drawing Sheets

HYDRAULIC PACKOFF AND CASING HANGER INSTALLATION TOOL

BACKGROUND

This invention relates to an apparatus and method for installing and setting an annular seal between the casing hanger and wellhead housing in an oil and gas well. The increased use of metal-to-metal sealing means for these wellhead annulus seals has created a need for means for generating the large loads needed to energize these seals. The blowout preventers typically positioned immediately above the wellhead housing are designed to seal against and withstand the high well bore pressures found in drilling operations. It has been proposed to use this capacity to activate a metal-to-metal seal. This technique has posed problems such as how to isolate the seal setting procedure to avoid pressurizing the formation, requiring the use of tools which must be sealed against the well bore drilling fluids to function properly, and using tools which require rotation of the drill pipe handling string while the blowout preventers are closed on the handling string.

This invention is for a wellhead seal and casing hanger installation tool which utilizes the hydraulic force available when the blowout preventers are sealed against a purpose built drill pipe sub and pressurized fluid is supplied through the kill and choke lines to the annulus between the drill pipe sub and the blowout preventer body. Fluid passages in the wall of the drill pipe sub direct the pressurized fluid to a hydraulically actuable piston which energizes and latches the wellhead annulus packoff. This eliminates the need for additional flow controlling means as ball valves or darts inserted in the drill pipe. The tool allows installation of the casing hanger and wellhead annulus packoff in a single trip while utilizing the aforementioned hydraulic force to simplify the seal setting procedure. The tool is particularly suited for use with metal-to-metal seals which often require high axial forces to initiate the seal.

Prior casing hanger and packoff installation tools include the M. R. Jones U.S. Pat. No. 3,093,996 which discloses a blowout preventer tester which lands in the wellhead housing and uses a floating piston as a medium separator to allow drilling fluids to be pumped down the drill pipe to pressurize inert gas injected into the blowout preventer body for testing purposes. The gas is injected through a valve and porting means in the blowout preventer body.

The C. C. Brown U.S. Pat. No. 3,279,539 shows a seal setting tool using a piston to activate a seal assembly. The tool requires a ball to be dropped down the drill pipe, and pressurizing the drill pipe to shift the piston and energize the seal.

The C. C. Brown U.S. Pat. No. 3,357,486 discloses another seal setting structure which allows for either mechanical or hydraulic actuation of the seal assembly. The Brown invention requires the seal setting structure to be aligned with a groove in the wellhead housing for proper orientation and operation.

The J. A. Haeber U.S. Pat. No. 3,543,847 discloses a seal installation tool which uses the weight of the drill string to initially set the seal and BOP test pressure to apply additional actuation load and activate a lockdown mechanism into an annular groove in the wellhead housing interior.

The A. G. Ahlstone U.S. Pat. No. 3,897,823 discloses a similar structure which utilizes a combination of drill string weight and hydraulic force to set the seal and uses a wedge-type lock against the interior wall of the wellhead housing.

The E. Thuse U.S. Pat. No. 4,019,579 and the M. E. Garrett U.S. Pat. No. 4,019,580 disclose an apparatus for installing a wellhead annulus packoff which includes a piston operated by hydraulic pressure supplied through the drill string and a nut and screw arrangement which converts the piston's linear movement into torque for energizing the packoff.

SUMMARY

The claimed invention pertains to a casing hanger and packoff installation tool which is used to set a packoff by utilizing a piston hydraulically operated by pressure supplied through the kill and choke line connected to the blowout preventers positioned immediately above the wellhead housing and porting means in the tool. The installation tool includes a central tubular member with a drill pipe upper connection and an annular chamber at the lower end thereof with a pair of concentric axially movable pistons mounted therein. A plurality of fluid passages are positioned in the wall of the tubular member and extend from the piston annular chamber to the middle portion of the tubular member where it exits. The pistons have a lower tubular extension which carries releasable latching means which connects the tool to the packoff to be installed and transmits the axial force of the pistons to the packoff. A drill pipe stinger extends through the annular chamber with a releasable latching means mounted on an enlarged lower portion. The releasable latching means connects the tool to the casing hanger for lowering the casing and hanger into the well bore.

An object of the present invention is to provide a packoff and casing hanger installation tool which will generate a high load for energizing metal-to-metal seals without requiring the rotation of drill pipe while the blowout preventers are closed thereon.

Another object of the present invention is to provide a packoff and casing hanger installation tool which utilizes the pressure containing and sealing attributes of the blowout preventers positioned above the wellhead to energize the packoff.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
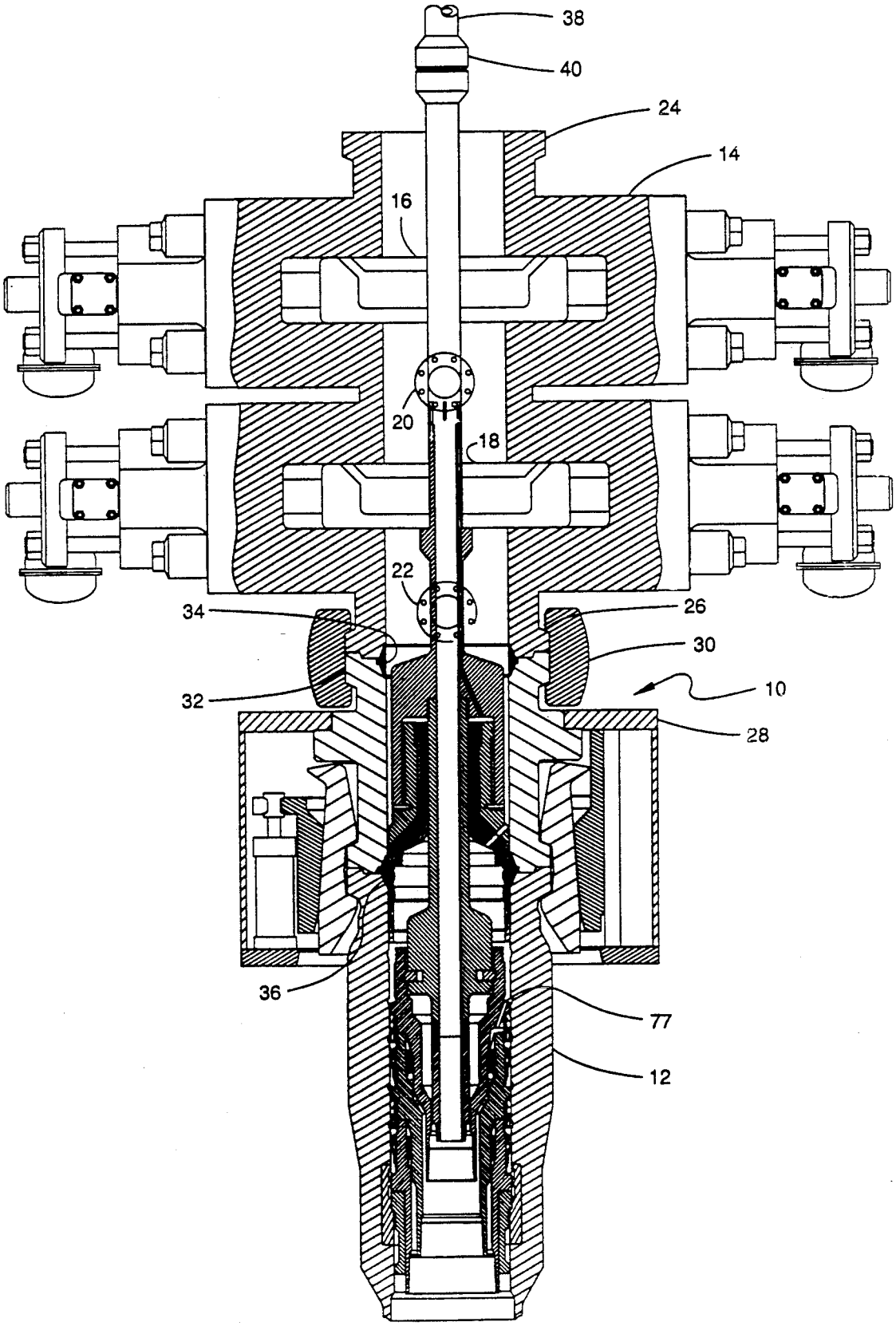
FIG. 1 is an elevation view, partly in section, of the hydraulic packoff and casing hanger installation tool in the wellhead housing with a casing hanger landed and a packoff held above the hanger by the installation tool.

With reference to FIG. 1, the hydraulic casing hanger and packoff installation tool is denoted generally by numeral 10 and is shown landed within wellhead housing 12. Wellhead housing 12 may be of the type used on land or subsea. Blowout preventer assembly 14 is a double ram type configuration well known to those skilled in the art and includes upper ram 16 and lower ram 18 with kill and choke line flanged port 20 therebetween and kill and choke line flanged port 22 below lower ram 18. Upper ram 16 and lower ram 18 are operated by pressurized hydraulic fluid supplied by suitable means as a hydraulic control bundle, not shown. Blowout preventer assembly 14 is provided with suitable end connection means as clamp hubs 24 and 26 at the top and bottom thereof, respectively.

Blowout preventer assembly 14 is connected to hydraulic collet connector 28 by suitable means as clamp 30, which maintains hub 26 in abutting relationship with hub 32 of connector 28 with gasket 34 sealing therebetween. Collet connector 28 is locked on wellhead housing 12 with gasket 36 sealing therebetween. Blowout preventer assembly 14, collet connector 28 and wellhead housing 12 form a continuous sealed conduit which is extended to the surface by riser pipe (not shown) which connects to clamp hub 24 of blowout preventer assembly 14. The hydraulic casing hanger and packoff installation tool 10 is lowered into position on drill pipe handling string 38 which attaches to tool 10 at drill pipe box connection 40.

Figure 2A:
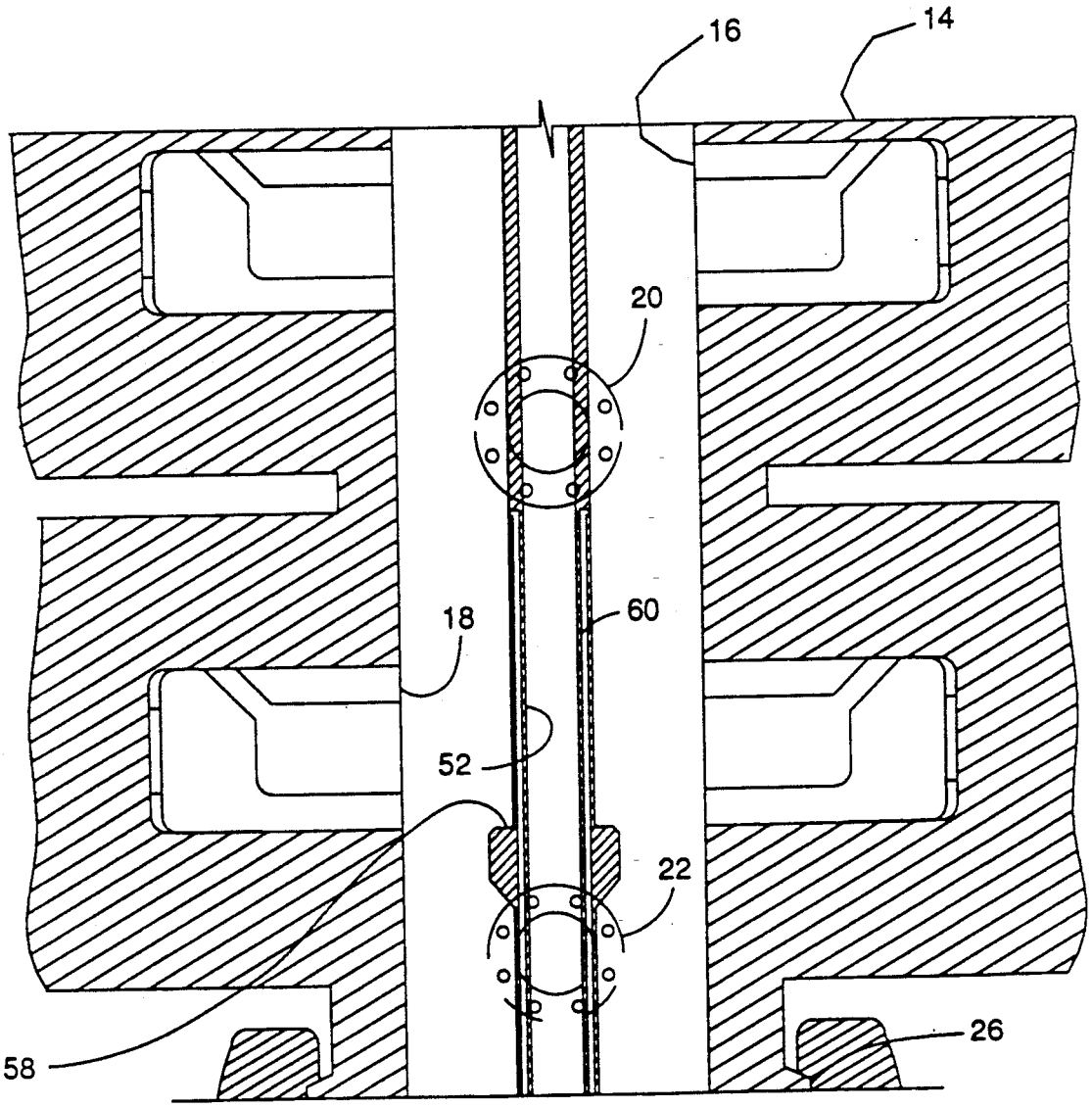
FIGS. 2A and 2B are views similar to FIG. 1, partly in section, on an enlarged scale showing the hydraulic packoff and casing hanger installation tool in greater detail with FIG. 2A being the upper portion and FIG. 2B being the lower portion thereof.
Figure 2B:
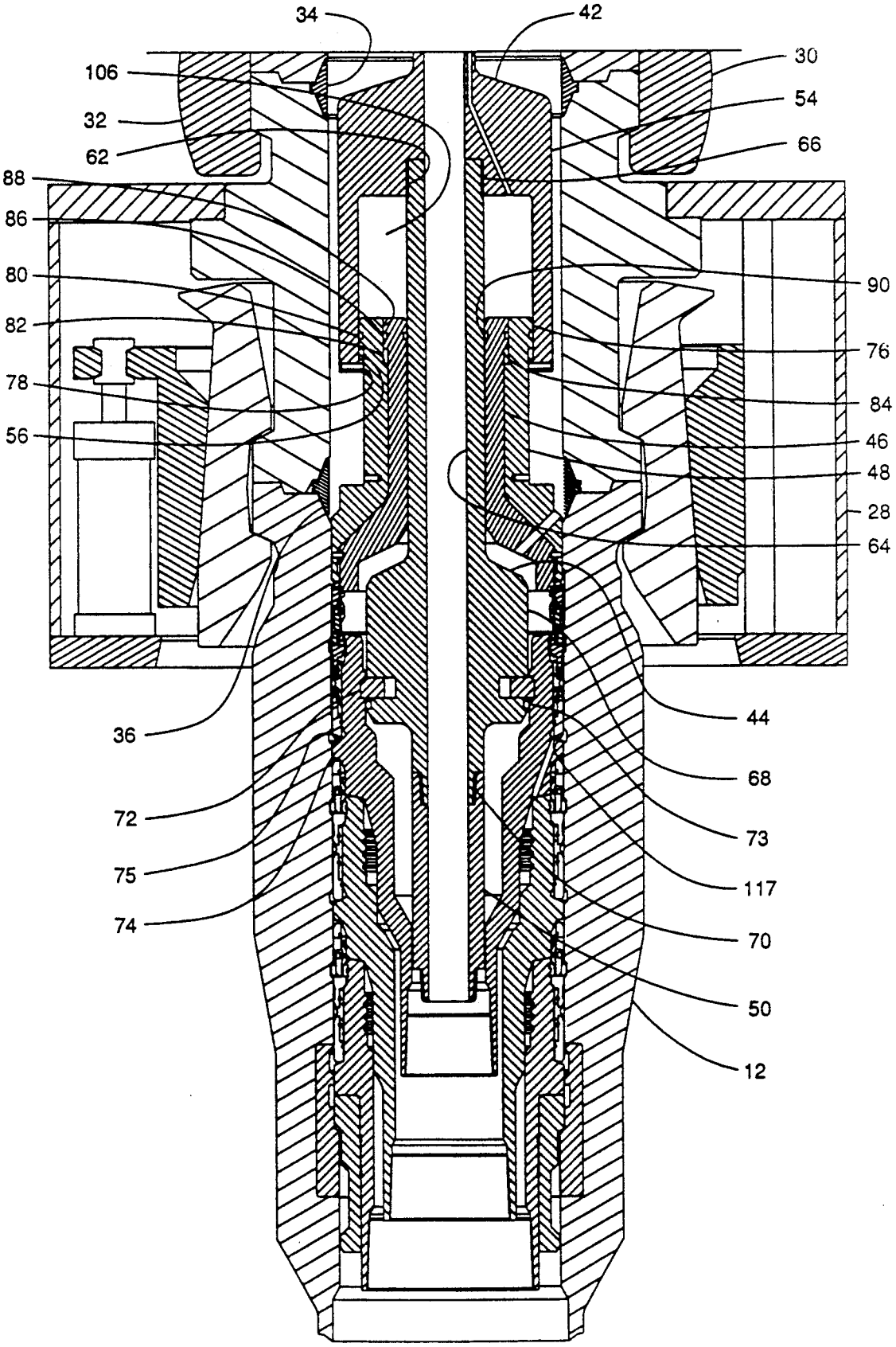
Figure 3A:
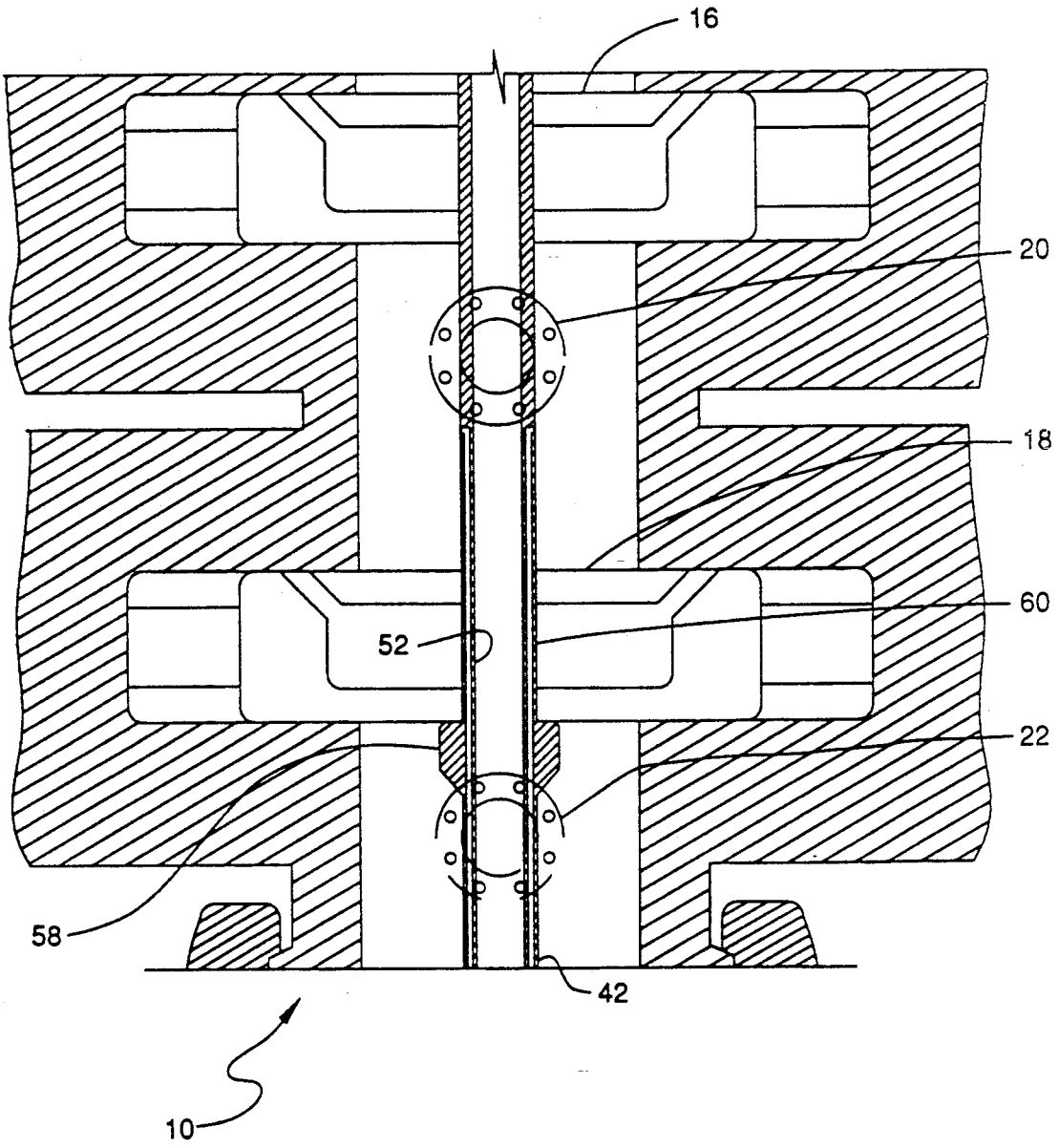
FIGS. 3A and 3B are views similar to FIG. 2 showing the packoff landed and set by the installation tool within the wellhead housing with FIG. 3A being the upper portion and FIG. 3B being the lower portion thereof.
Figure 3B:
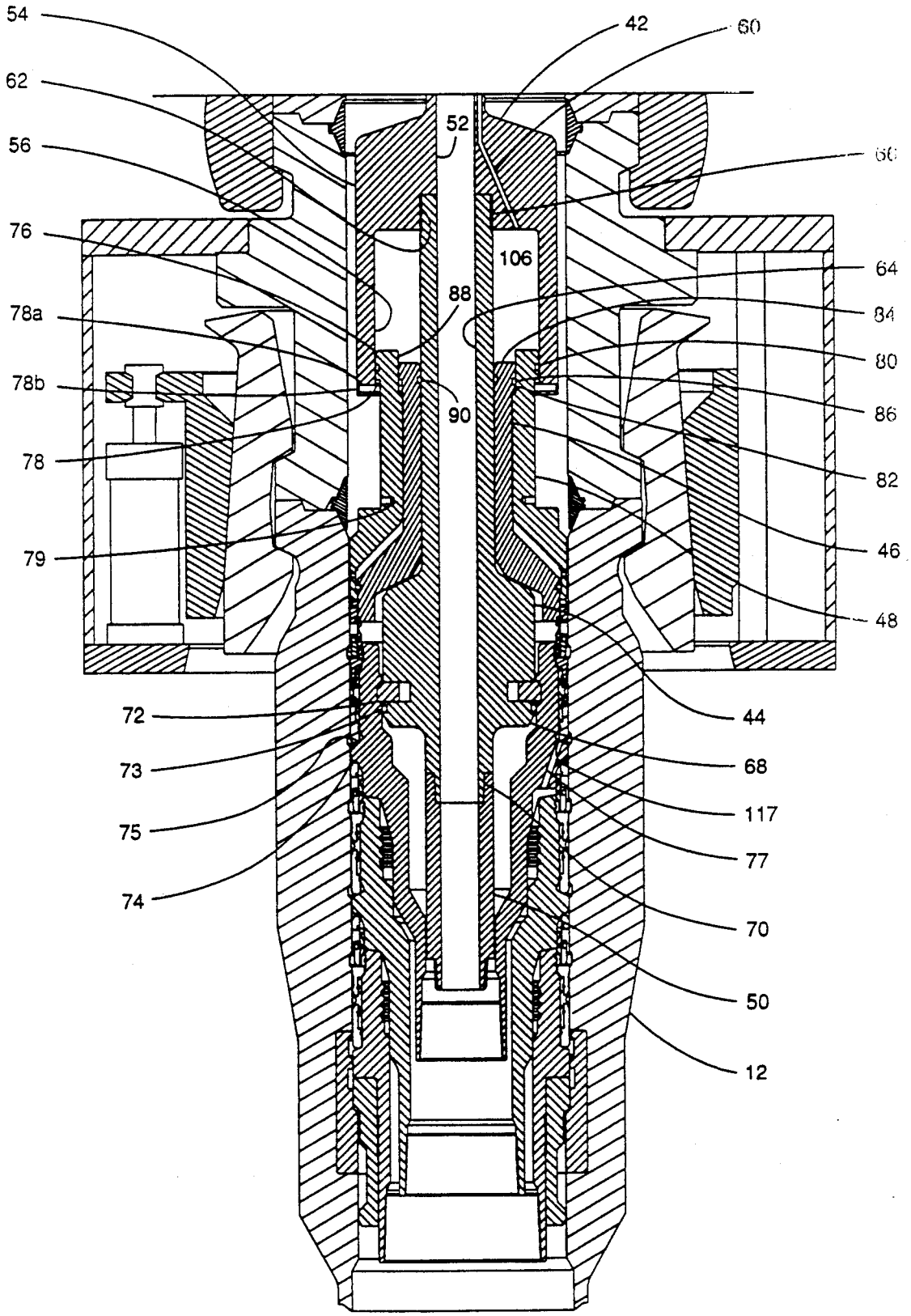
Figure 4A:
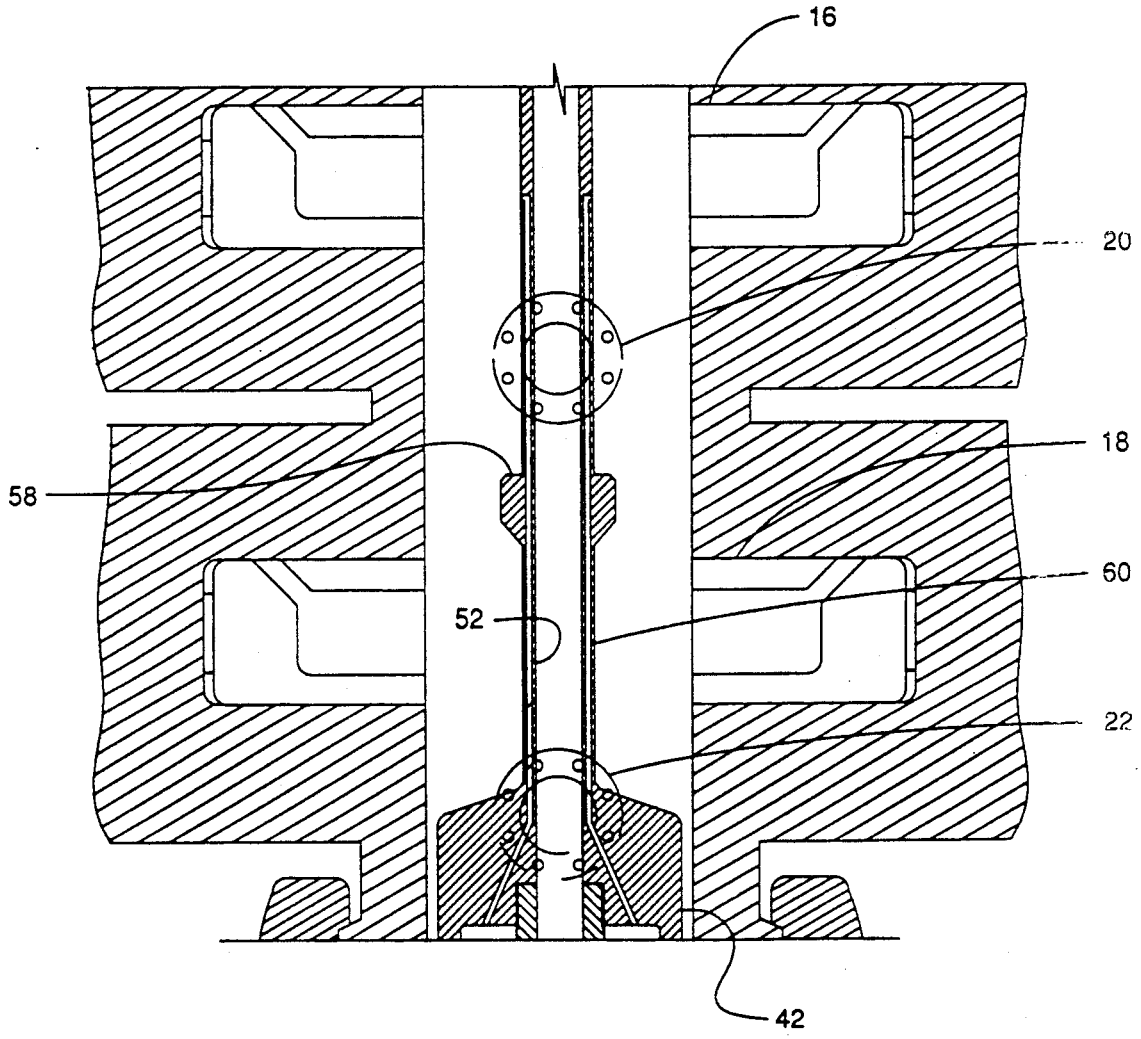
FIGS. 4A and 4B are views similar to FIG. 3 showing the hydraulic packoff and casing hanger installation tool released from the casing hanger and packoff with FIG. 4A being the upper portion and FIG. 4B being the lower portion thereof.
Figure 4B:
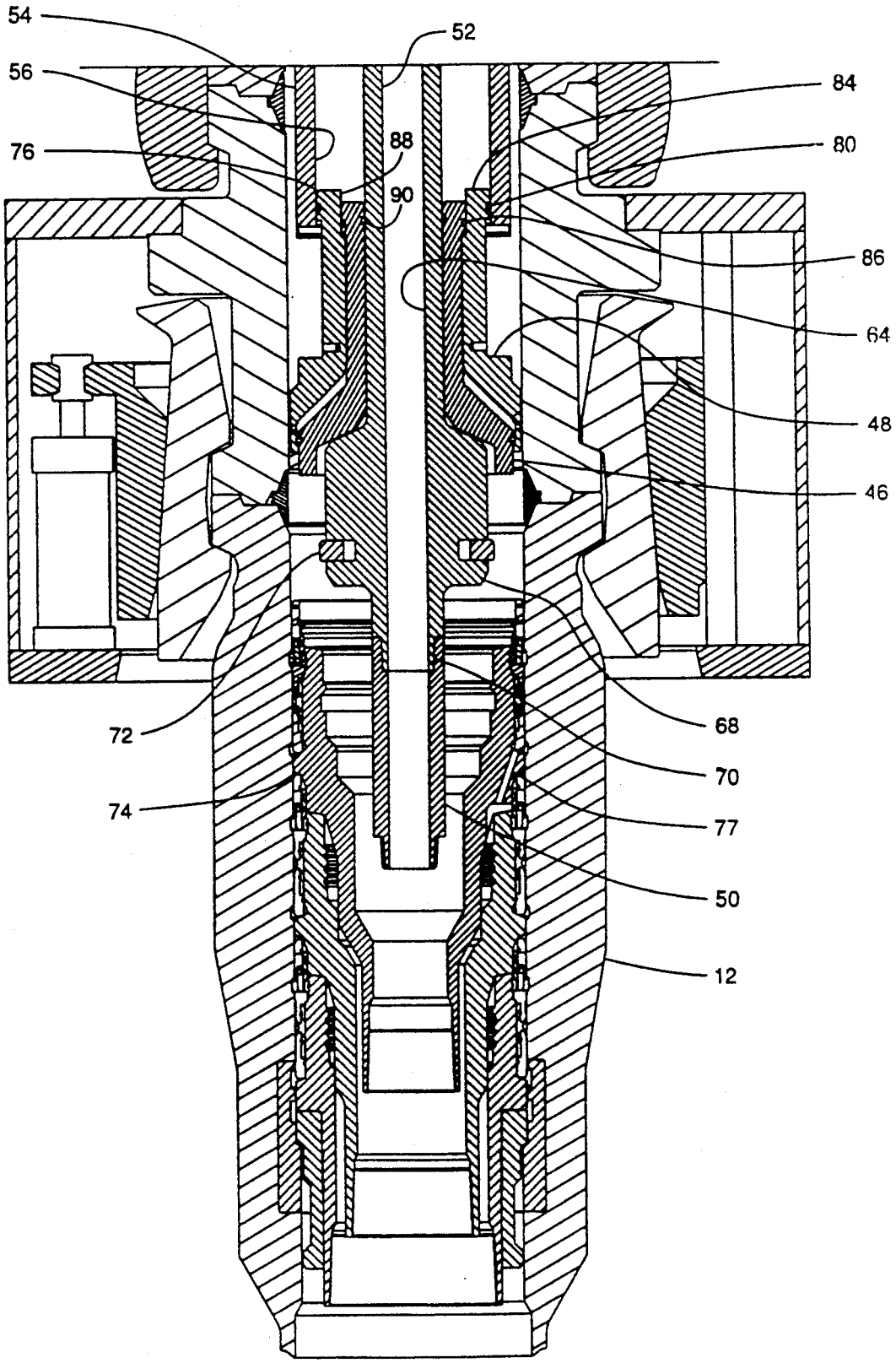

With reference to FIG. 2, the hydraulic casing hanger and packoff installation tool 10 includes housing 42, hanger sub 44, inner piston 46, outer piston 48 and cementing stinger 50. Housing 42 is a generally tubular member with central bore 52 extending therethrough and enlarged diameter portion 54 forming the lower end thereof. The upper end of housing 42 terminates in drill pipe box connection 40. Enlarged lower portion 54 has recess 56 formed in its lower face with inner piston 46 and outer piston 48 disposed therein. An enlarged diameter portion medially located on housing 42 forms stop shoulder 58 for cooperation with lower ram 18 in a manner to be described hereinafter. A plurality of axially disposed ports 60 are circumferentially spaced in the wall of housing 42. The upper end of ports 60 exit radially through the wall of housing 42 between stop shoulder 58 and drill pipe connection 40. The length of housing 42 is chosen to ensure the upper end of ports 60 is between upper ram 16 and lower ram 18 when the hydraulic casing hanger and packoff installation tool 10 is landed within wellhead housing 12. The lower end of ports 60 exit housing 42 into recess 56. Central bore 52 has suitable connection means as drill pipe box connection 62 at its lower end, adjacent recess 56.

Hanger sub 44 is a generally tubular member with central bore 64 extending therethrough and has a suitable connection means as drill pipe pin connection 66 at its upper end which sealingly engages box connection 62 within recess 56 of housing 42. Hanger sub 44 has enlarged diameter portion 68 forming the lower portion thereof with drill pipe pin connection 70 extending therebelow. Cementing stinger 50 connects to pin connection 70 for connection to cementing equipment (not shown) in a manner which is well known to those skilled in the art. Suitable latching means as cam actuated dogs 72 which are radially disposed about lower portion 68 of housing 42, allow hydraulic casing hanger and packoff installation tool 10 to be latched into casing hanger 74. Suitable sealing means as O ring 73 is disposed below cam actuated dogs 72 on lower portion 68 of housing 42 and seals within casing hanger 74 when cam actuated dogs 72 are engaged.

Figure 1A:
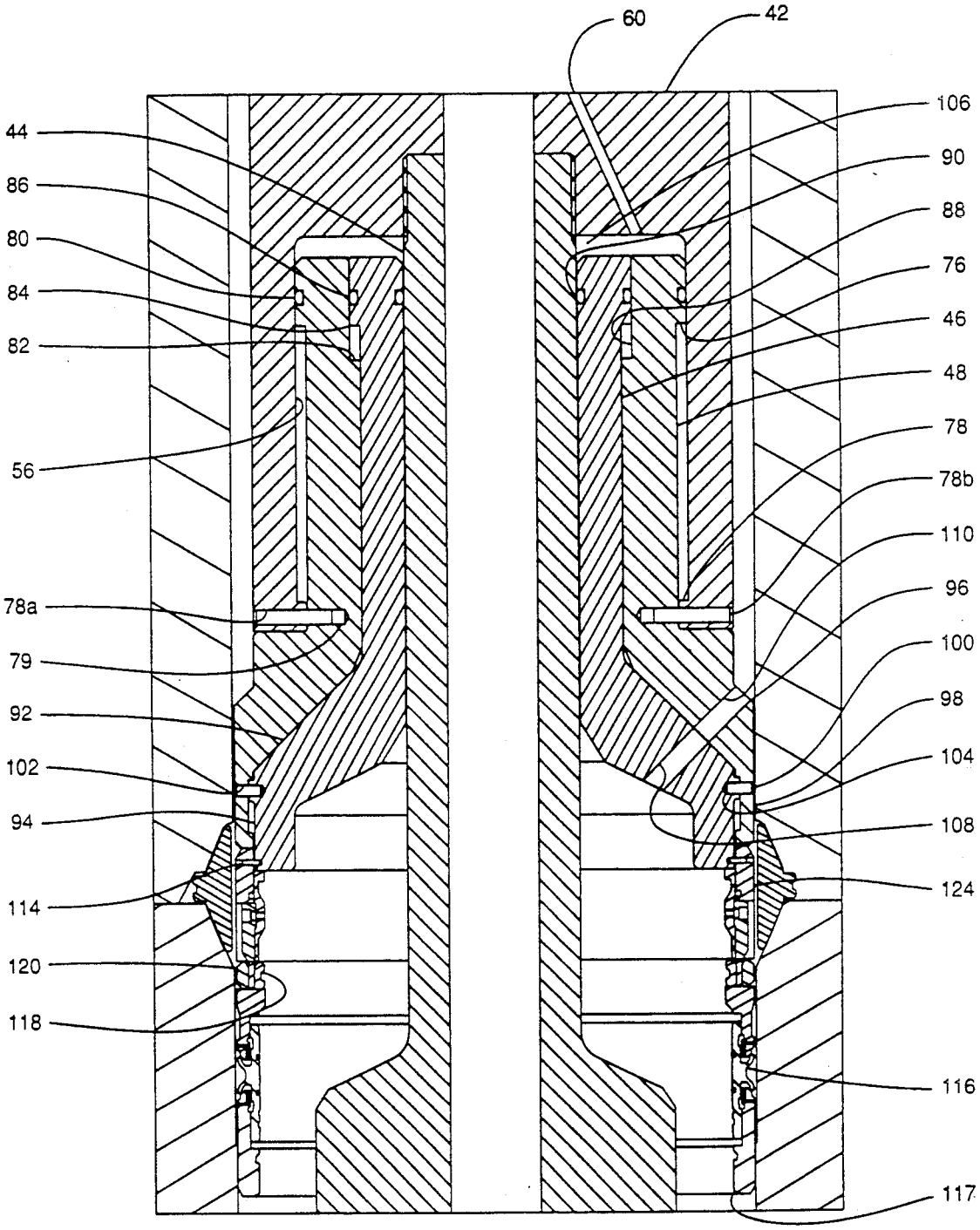
FIG. 1A is an enlarged view in section showing the inner and outer pistons of the packoff installation tool in detail in the running position.

Recess 56 of housing 42 has inner piston 46 and outer piston 48 disposed therein as best seen in FIG. 1A. Outer piston 48 has shoulder 76 at its upper end which engages shoulder 78 at the lower end of recess 56 to limit its downward movement. Shoulder 78 has radial holes **78*a* circumferentially disposed and extending therethrough. Shear pins 78*b* extend through radially disposed holes 78*a* to engage blind holes 79 in outer piston 48 for purposes to be explained hereinafter. Suitable sealing means as O ring 80 is positioned on the exterior of shoulder 76 and seals within recess 56. Upwardly facing shoulder 82 is formed on the interior of outer piston 48 and engages rim 84 on the exterior of inner piston 46 to limit its downward motion. O ring 86 on the exterior of rim 84 seals within bore 88 of outer piston 48 above shoulder 82. The interior of inner piston 46 has O ring 90 disposed therein which seals against the exterior of hanger sub 44**.

Figure 5:
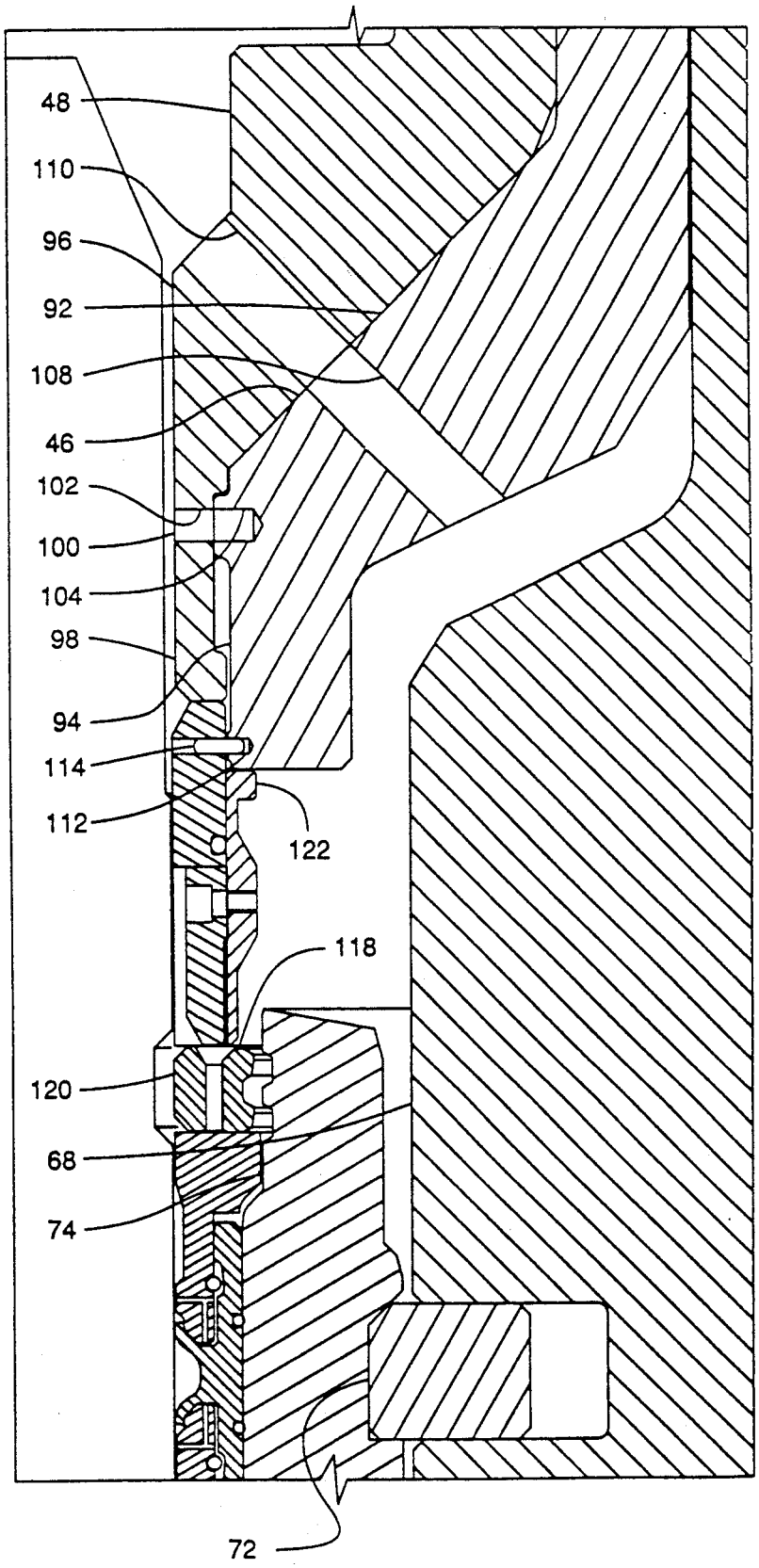
FIG. 5 is an enlarged view in section showing the inner and outer pistons of the packoff installation tool in detail in the set but unlocked position.

The lower portion of inner piston 46 has an enlarged diameter to form inner skirt 92 and lower rim 94. The lower portion of outer piston 48 has a similarly configured lower end forming outer skirt 96 and lower rim 98 which closely fit about skirt 92 and rim 94 as best seen in FIGS. 1A and 5. Shear pins 100 extend through radially disposed holes 102 in lower rim 98 of outer piston 48 to engage blind holes 104 in lower rim 94 of inner piston 46. With shear pins **78*b* and 100 thus installed, inner piston 46 and outer piston 48 are as shown in FIG. 1A, with O rings 80, 86 and 90 sealing the annulus formed between recess 56 and the exterior of hanger sub 44 to form annular chamber 106 with which ports 60** communicate.

Inner skirt 92 and outer skirt 96 have a plurality of obliquely disposed flow ports 108 and 110 circumferentially arranged thereabout to allow flow returns past the hydraulic casing hanger and packoff installation tool 10 during cementing operations. Lower rim 94 has radially disposed blind holes 112 therein which receive shear pins 114 to attach packoff assembly 116 thereto. Packoff assembly 116 is of conventional configuration well known to those skilled in the art with lock ring 118 disposed on the interior and latch ring 120 disposed on the exterior.

A typical sequence of operations for using the hydraulic casing hanger and packoff installation tool 10 begins with the installation of shear pins 100 through holes 102 in lower rim 98 of outer piston 48 to engage blind holes 104 in lower rim 94 of inner piston 46. With inner piston 46 and outer piston 48 thus pinned the pistons will move as one unit when pressurized fluid is introduced into annular chamber 106. The pistons 46 and 48 are then moved to the position shown in FIG. 1A and shear pins 78*b* are installed through holes 78*a* into blind holes 79 in outer piston 48 to retain the pistons in an initial running position. Packoff assembly 116 is installed on lower rim 94 of inner piston 46 and retained by shear pins 114.

Cementing equipment (not shown) as is well known to those skilled in the art is connected to cement stinger 50. The hydraulic casing hanger and packoff installation tool 10 is latched within casing hanger 74 by cam actuated dogs 72 which are actuated by rotating the housing 42. The assembly composed of casing hanger 74, packoff assembly 116 and the hydraulic casing hanger and packoff installation tool 10 is set back in the derrick and the casing string (not shown) is run through blowout preventer assembly 14 and wellhead housing 12 into the wellbore. After the last joint of casing is run, the aforementioned assembly is connected to drill pipe handling string 38 by drill pipe box connection 40 and the assembly is connected to the casing string by casing hanger 74. The assembly and casing string is then lowered through blowout preventer assembly 14 until casing hanger 74 lands within wellhead housing 12. Cementing operations are carried out in a manner well known to those skilled in the art with flow returns passing through flow passages 77 in casing hanger 74 and flow ports 108 and 110 of pistons 46 and 48 and through the annulus between running string 38 and blowout preventer assembly 14 to the surface.

Upper ram 16 and lower ram 18 of blowout preventer assembly 14 are closed on housing 42 of hydraulic casing hanger and packoff installation tool 10 with stop shoulder 58 immediately below lower ram 18. Pressurized fluid is supplied through a kill and choke line (not shown) to flanged port 20. The pressurized fluid enters ports 60 and is transmitted to annular chamber 106 above pistons 46 and 48. Pressurization of chamber 106 causes shear pins 78*b* to shear and pistons 46 and 48 to move downward as a unit, carrying packoff assembly 116 therewith. As packoff assembly 116 is pushed into the annulus between wellhead housing 12 and casing hanger 74, any reaction force transmitted to hydraulic casing hanger and packoff installation tool 10 is reacted by stop shoulder 58 against lower ram 18.

Figure 6:
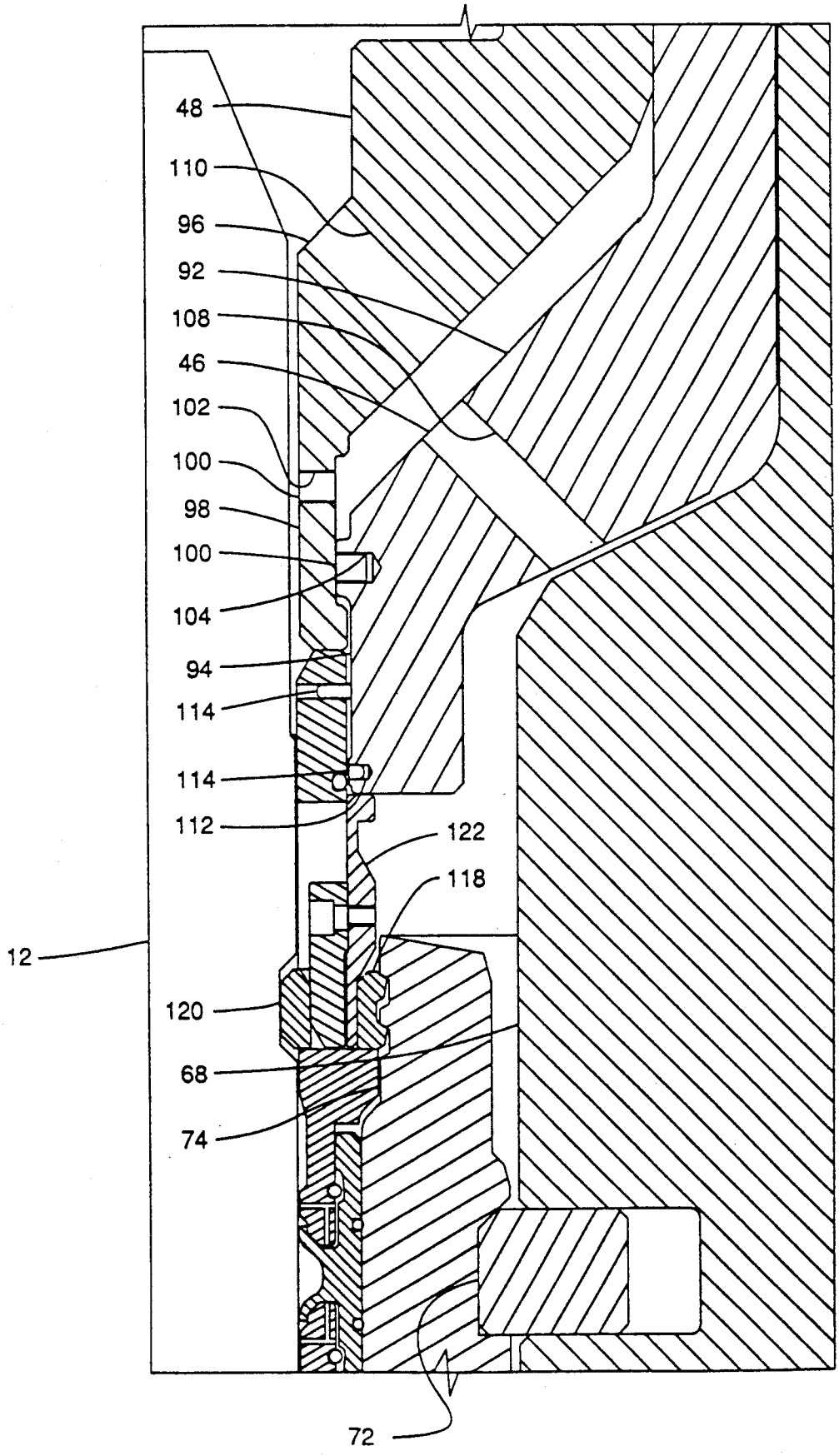
FIG. 6 is an enlarged view similar to FIG. 5 showing the packoff installation tool in the set and locked position.

As shoulder 117 of packoff assembly 116 bottoms against upwardly facing shoulder 75 of casing hanger 74, the pressurized fluid in chamber 106 acts across pistons 46 and 48 between seals 80 and 90 to generate a setting force sufficient to urge packoff assembly 116 into sealed relationship with hanger 74 and wellhead housing 12. Once packoff assembly 116 is fully energized, further downward movement of outer piston 48 is prevented. Continued pressurization of annular chamber 106 causes shear pins 100 and 114 to shear, thereby allowing inner piston 46 to move downward relative to outer piston 48. Shear pins 100 are sized to ensure the required setting load is transmitted to packoff assembly 116 before shear pins 100 are sheared. As best seen in FIG. 6, this downward movement of inner piston 46 moves wedge ring 122 of packoff assembly 116 downward and cams latch ring 120 into engagement with wellhead housing 12 and cams lock ring 118 into engagement with casing hanger 74. The shearing of pins 114 frees the hydraulic casing hanger and packoff installation tool 10 from packoff assembly 116.

A pressure test of the packoff assembly 116 can be made with casing hanger 74 and packoff assembly 116 thus installed by pressurizing the wellhead housing 12 and blowout preventer assembly 14 above packoff assembly 116. With lower ram 18 still closed on housing 42, pressurized fluid is supplied through a kill and choke line (not shown) to flanged port 22 below ram 18. The pressurized fluid acts against packoff assembly 116 to provide a seal integrity test. Once the test is complete, upper ram 16 and lower ram 18 are retracted and cam actuated dogs 72 are then released from casing hanger 74 by rotation of handling string 38 and tool housing 42 and the hydraulic casing hanger and packoff installation tool 10 is raised to the surface on drill pipe handling string 38.

It should be noted that the scope of the invention is not limited to a double ram blowout preventer but is equally applicable to an embodiment in which a pair of blowout preventer pipe sealing means are spaced apart to allow pressurized drilling fluid to be supplied to the ports 60 in the tool. This could include such configurations as a ram type blowout preventer for the lower sealing means in combination with an annular type blowout preventer for the upper sealing means to provide the sealed annulus required to operate the tool. Similarly, a pair of annular blowout preventers could be used with the proper spacing therebetween to allow pressurized fluid to enter the ports 60 in the tool.

What is claimed is:

1. A packoff installation tool for use with a pair of blowout preventers each having pipe sealing means therein, with fluid porting means therebetween wherein the blowout preventers are disposed above a wellhead housing having a casing hanger landed therein, comprising:

a tubular member having a central bore therethrough with an annular chamber disposed at the lower end thereof exteriorly of said tubular member's exterior wall, an axially movable pressure responsive means disposed within said annular chamber, a fluid communication means connecting the volume between said pair of pipe sealing means and exterior of said tubular member and the volume of said annular chamber above said pressure responsive means, and a releasable latching means connecting said pressure responsive means to a wellhead annulus packoff.

2. A packoff installation tool according to claim 1 wherein:

said tubular member extends above said pipe sealing means within said blowout preventers and has means disposed on the upper end for connecting to a drill pipe sub, said fluid communication means including an axial bore disposed in the wall of the tubular member, and said axial bore radially exiting said tubular member intermediate its upper and lower ends.

3. A packoff installation tool according to claim 2 wherein:

said axial bore radial exit is between said pair of pipe sealing means when said packoff installation tool is landed.

4. A packoff installation tool according to claim 3 including:

a stinger sealingly secured to said tubular member and extending axially through said annular chamber with a central bore fluidly communicating with said central bore of said tubular member, said pressure responsive means is a piston with sealing means disposed thereon for sealing against said stinger and said annular chamber, and said piston has a tubular extension with fluid bypass ports therethrough to allow fluid returns to bypass said annulus packoff during cementing operations.

5. A packoff installation tool according to claim 4 wherein:

said wellhead annulus packoff releasable latching means is disposed on said tubular extension of said piston, and said releasable latching means transmits axial force to said packoff when said annular chamber is pressurized.

6. A packoff installation tool according to claim 5 wherein:

said stinger has an enlarged lower portion for locating said packoff installation tool in an initial unset position with respect to said casing hanger.

7. A casing hanger and packoff installation tool for use with a pair of blowout preventers each having pipe sealing means therein, with fluid porting means therebetween wherein the blowout preventers are disposed above a wellhead housing having a casing hanger landed therein, comprising:

a tubular member having a central bore therethrough with an enlarged lower portion defining an annular chamber between the exterior of said tubular member and the interior of said enlarged lower portion, an axially movable pressure responsive means disposed within said annular chamber, a fluid communication means connecting the volume between said pair of pipe sealing means and exterior of said tubular member and the volume of said annular chamber above said pressure responsive means, a releasable latching means connecting said pressure responsive means to a wellhead annulus packoff, and a releasable latching means connecting said tubular member to said casing hanger.

8. A casing hanger and packoff installation tool according to claim 7 wherein:

said tubular member extends above said pipe sealing means within said blowout preventers and has means disposed on the upper end for connecting to a drill pipe sub, said fluid communication means including an axial bore disposed in the wall of the tubular member, and said axial bore radially exiting said tubular member intermediate its upper and lower ends.

9. A casing hanger and packoff installation tool according to claim 8 wherein:

said axial bore radial exit is between said pair of pipe sealing means when said casing hanger and packoff installation tool is landed.

10. A casing hanger and packoff installation tool according to claim 9 including:

a stinger sealingly secured to said tubular member and extending axially through said annular chamber with a central bore fluidly communicating with said central bore of said tubular member, said pressure responsive means is a piston with sealing means disposed thereon for sealing against said stinger and said annular chamber, and said piston has a tubular extension with fluid bypass ports therethrough to allow fluid returns to bypass said annulus packoff during cementing operations.

11. A casing hanger and packoff installation tool according to claim 10 wherein:

said wellhead annulus packoff releasable latching means is disposed on said tubular extension of said piston, and said pack of releasable latching means transmits axial force to said packoff when said annular chamber is pressurized.

12. A casing hanger and packoff installation tool according to claim 11 wherein:

said stinger has an enlarged lower portion for locating said casing hanger and packoff installation tool in an initial position with respect to said casing hanger, and said releasable latching means connecting said tubular member to said casing hanger is disposed on said stinger enlarged lower portion.

13. A method of installing a casing hanger and annulus packoff wherein a pair of blowout preventers each having pipe sealing means therein, with fluid porting means therebetween, are disposed above a wellhead housing, comprising the steps of:

assembling a casing string, casing hanger and annulus packoff on an installation tool prior to lowering into a well bore, lowering said installation tool on drill pipe into said well bore until said casing hanger lands on a shoulder within said wellhead housing adapted to receive said casing hanger, cementing said casing string in the well bore while circulating fluids upwardly between the casing hanger and the wellhead housing, activating said pipe sealing means into sealing engagement with a central tubular portion of said installation tool, introducing pressurized fluid into the volume between said pair of sealing means and exterior of the tubular portion of said installation tool, communicating said pressurized fluid through porting means to the upper face of a pressure responsive piston on the lower portion of said installation tool which is operatively connected to said packoff, moving said packoff into locking and sealing engagement in the annulus between said casing hanger and said wellhead housing by maintaining said pressurized fluid on the upper face of said pressure responsive piston, releasing said pressurized fluid through said porting means in said installation tool and said blowout preventers, deactivating said pipe sealing means to a retracted position, and releasing said installation tool from said casing hanger and retrieving said installation tool from the well bore.

* * * * *